United States Patent [19]

DiRienzo

[11] Patent Number: 4,498,606

[45] Date of Patent: Feb. 12, 1985

[54] EMERGENCY FUEL FLOW SHUT-OFF DEVICE

[76] Inventor: Armand DiRienzo, 803 New Chestnut St., Bristol, Pa. 19007

[21] Appl. No.: 442,632

[22] Filed: Nov. 18, 1982

[51] Int. Cl.[3] ..... B67D 5/32

[52] U.S. Cl. ..... 222/52; 222/541; 137/68 R; 137/355.16

[58] Field of Search ..... 222/40, 52, 63, 504, 222/541; 340/568, 686, 687; 137/68 R, 355.16, 456, 457, 460, 461, 487.5

[56] References Cited

U.S. PATENT DOCUMENTS

| | | | |
|---|---|---|---|
| 1,857,969 | 5/1932 | Nelson | 222/74 |
| 1,864,233 | 6/1932 | De Lancey | 222/63 |
| 2,070,560 | 2/1937 | Bradley | 221/95 |
| 2,211,476 | 8/1940 | Nelson | 221/95 |
| 2,840,272 | 6/1958 | Blackburn et al. | 222/63 X |
| 2,880,909 | 4/1959 | Clymer et al. | 222/54 |
| 2,906,280 | 9/1959 | Mount | 137/68 R |
| 3,509,942 | 5/1970 | Lindberg | 222/52 X |
| 3,878,507 | 4/1975 | Medlock | 340/63 |
| 3,893,095 | 7/1975 | De Jong | 340/272 |
| 4,180,088 | 12/1979 | Mallett | 137/87 |

*Primary Examiner*—Joseph J. Rolla
*Assistant Examiner*—Michael S. Huppert
*Attorney, Agent, or Firm*—Howson and Howson

[57] ABSTRACT

A device for use in automatically shutting off the flow of fuel from a dispenser is disclosed. The device comprises a servo valve connected to a fuel delivery hose through a conduit having a weakened wall section adjacent the valve. Power is supplied to the valve through a switch having an actuator which laterally engages the conduit to hold the switch normally closed for maintaining the control valve normally open. In response to pulling of the hose away from the dispenser, the valve actuator moves and opens the switch for deenergizing the control valve and thereby shutting off fuel to the delivery hose.

10 Claims, 4 Drawing Figures

EMERGENCY FUEL FLOW SHUT-OFF DEVICE

FIELD OF THE INVENTION

The present invention relates to emergency fuel flow shut-off devices, and more particularly, the present invention relates to an emergency shut-off device which is particularly suited for use in combination with a service station fuel dispenser.

BACKGROUND OF THE INVENTION

In recent years, self-service stations have proliferated in response to a demand for low cost motor vehicle fuel. Cost savings are realized by the customer pumping gas himself and subsequently paying the service station attendant. Self-service stations have, however, created certain problems.

One of the major problems is the fire hazard associated with fuel spilled on the ground around the fuel dispenser. The most hazardous fuel spills result when a customer drives his car away from the fuel dispenser without having first removed the nozzle from the fuel tank and shutting off the pump. This can result in the hose rupturing and fuel being pumped onto the ground around the dispenser. Because of the advent of dispensers which measure and totalize fuel volumes pumped, an accident such as this can result, not only in a serious fire hazard, but in a loss of a record of the volume of fuel dispensed prior to the accident.

Several efforts have been made to ameliorate this problem. For instance, U.S. Pat. No. 1,864,233 discloses a device for cutting off fuel flow from a fuel dispenser in an emergency. The device includes a valve having an operating handle connected via a cable to the dispensing hose adjacent its connection to the dispenser. In the event that someone should drive away with the nozzle in the fuel tank, the hose is pulled away from the dispenser and this, in turn, pulls on the cable and automatically closes the fuel supply valve. U.S. Pat. Nos. 1,857,969 and 2,211,476 both disclose automatic fuel flow shut-off devices utilizing either a pneumatic or an electrical actuator operated by a service station attendant while filling a fuel tank. U.S. Pat. No. 2,070,506 discloses another type of automatic shut-off device which utilizes a flexible member that yields under abnormal strain to actuate a switch for shutting off power to the pump in the event that the dispensing hose is hooked by an automobile bumper and pulled away from the dispenser. A pressure responsive automatic fuel shut-off device is disclosed in U.S. Pat. No. 2,880,909.

While each of the aforementioned patented devices may function satisfactorily for its intended purpose, there is an ever present demand for an emergency fuel flow shut-off device which is relatively simple in construction, automatic and positive in actuation, and easy to install and maintain.

OBJECTS OF THE INVENTION

With the foregoing in mind, a primary object of the present invention is to provide a novel emergency shut-off device for fuel dispensing systems.

It is another object of the present invention to provide an improved system for halting the discharge of fuel from a fuel dispenser under certain emergency situations.

As a further object, the present invention provides a unique emergency fuel flow cut-off system which operates quickly and automatically to halt the discharge of fuel from a dispenser in the event that the fuel dispensing hose is pulled away from the dispenser with excessive force.

As yet another object, the present invention provides an automatic emergency fuel flow cut-off system which is relatively simple in construction, which is positive in actuation, and which can be maintained easily.

SUMMARY OF THE INVENTION

More specifically, the present invention provides emergency fuel flow cut-off apparatus which is particularly suited for use in halting the flow of fuel from a fuel dispenser in the event that its flexible delivery hose is pulled from the dispenser with excessive force. The apparatus comprises a servo control valve which is connected to the hose by a conduit having a frangible section between its ends, and means associated with the conduit for detecting breakage thereof and providing a signal for closing the servo control valve and thereby preventing discharge of fuel from the dispenser. Preferably, the breakable portion of the conduit is provided by a zone of reduced wall thickness adjacent the valve, and the breakage detecting means includes a switch having an actuator laterally engaging the conduit downstream of the reduced wall thickness of the conduit. As a result, in the event that a driver should forget to turn off the dispenser and drive off with the nozzle still in the tank inlet, or in the event that a vehicle bumper hooks onto the delivery hose while moving, the hose is pulled laterally with respect to the conduit causing it to break and thereby actuate the switch for closing the servo valve and preventing fuel from being discharged onto the ground around the dispenser.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
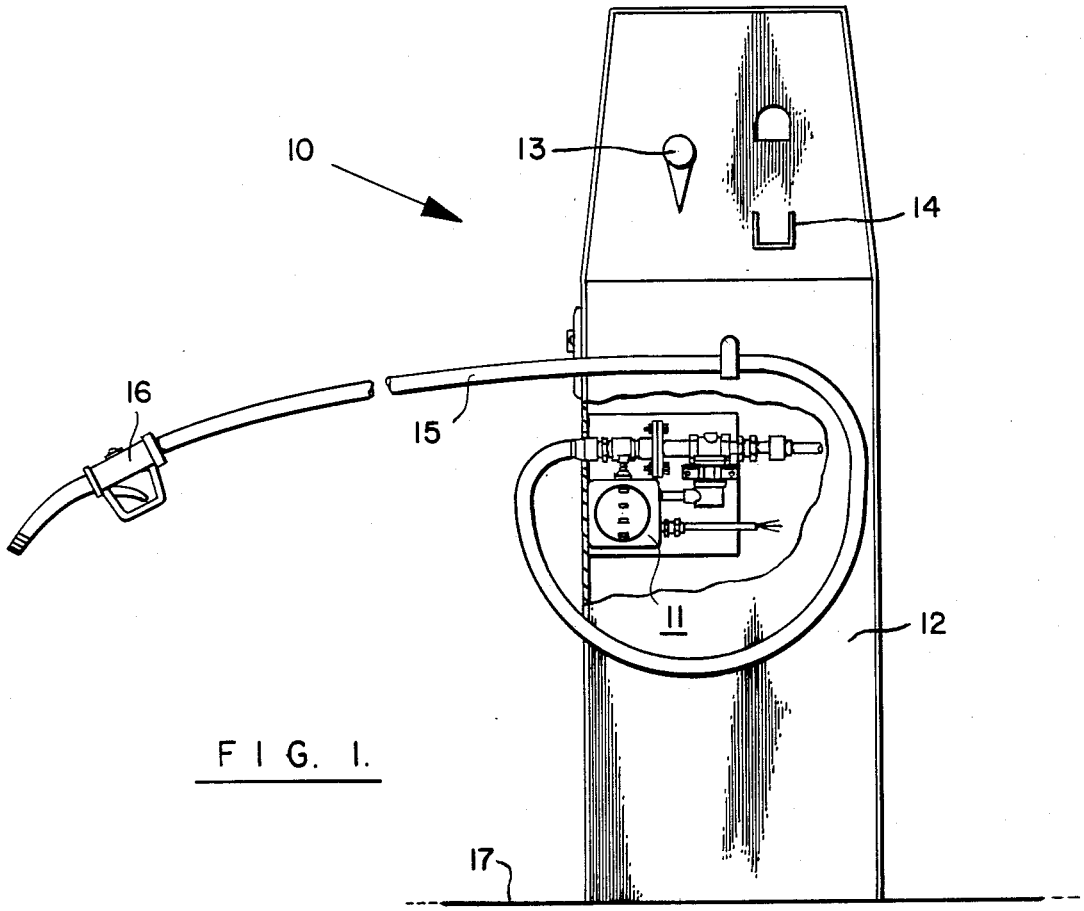
FIG. 1 is a side elevational view of a fuel dispenser having a portion of its side wall broken away to expose the emergency fuel flow cut-off apparatus of the present invention.
Figure 2:
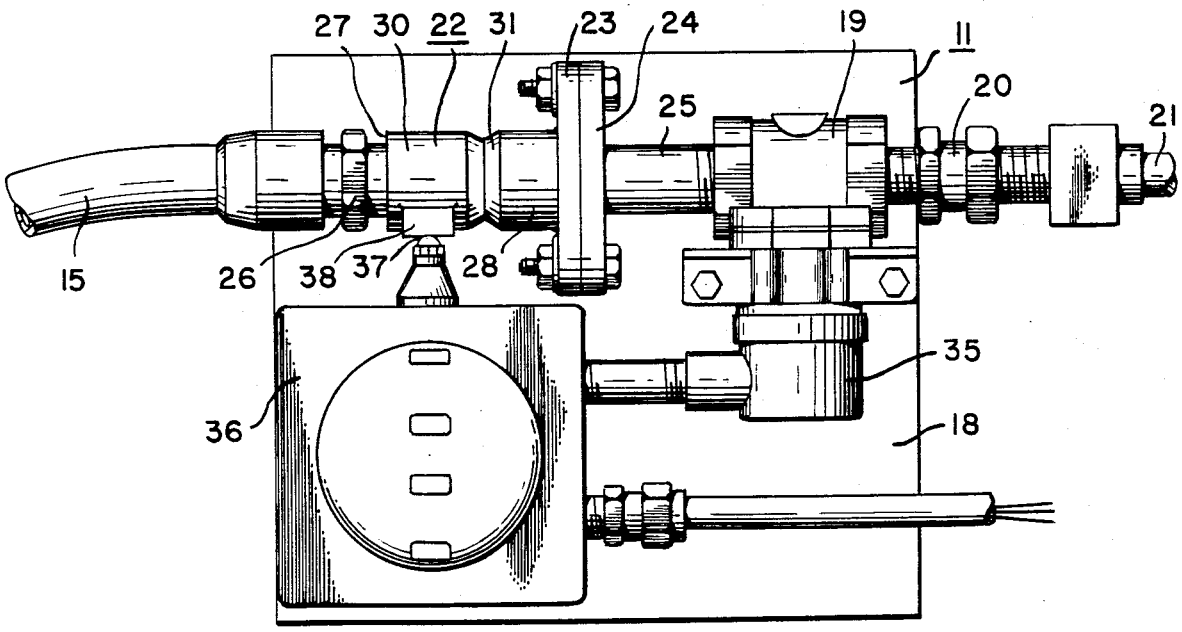
FIG. 2 is an enlarged side elevational view of the emergency fuel flow cut-off apparatus illustrated in FIG. 1.

Referring now to the drawings, FIG. 1 illustrates a fuel dispenser 10 with which is associated emergency fuel flow cut-off apparatus 11 which embodies the present invention. The fuel dispenser 10 comprises an upstanding stanchion 12 of conventional construction and having an upper section with an on-off switch 13 and a hose nozzle receiver 14. A flexible fuel delivery hose 15 extends away from the stanchion 12 and terminates in a nozzle 16 adapted to be inserted into the inlet of the fuel tank of a vehicle. In the conventional fuel dispenser, fuel is dispensed from the nozzle 16 when the on-off switch 13 is placed in the on position to actuate a submersible pump (not shown) which forces fuel under pressure through the hose 15 and out the nozzle 16 in a well known manner.

As discussed heretofore, a fire hazard can result when the nozzle 16 is inadvertently left in the fuel tank of an automobile and the switch 13 is left on while the vehicle is driven away from the stanchion 12. This has been known to cause the hose 15 to rupture and/or to pull the stanchion 12 off its mounting and thereby spill fuel on the ground 17 around the base of the stanchion 12. Needless to say, the fuel spilled on the ground 17 has, on a number of occasions, resulted in serious fires.

According to the present invention, the emergency fuel flow cut-off device 11 operates automatically to arrest the flow of fuel to the hose 15 in the event that it should be pulled away from the stanchion 12, such as in the manner noted above. To this end, the apparatus 11 comprises a base plate 18 to which is secured a servo valve 19 connected by a coupling 20 to a pipe 21 connected to the discharge side of a fuel pump, such as a submersible pump P (FIG. 3) mounted in a fuel tank located below the dispenser 10. A conduit 22 is connected downstream of the servo control valve 19 by a flange 23 which is bolted to a flange 24 connected to the end of a nipple 25 threaded into the valve 19. The conduit 22 is connected to the hose 15 by means of a coupling 26 threaded into its outer end 27. Thus, the inner end 28 of the conduit 22 is mounted stationary relative to the valve 19 and base 18 while the free end 27 which is connected to the hose 15 extends unsupported in cantilever fashion away from the inner end 28 which, as noted above, is connected to the valve 19 by the bolted mounting flanges 23 and 24 and nipple 25.

In order to detect excessive movment of the hose 15 relative to the base 18, and hence the stanchion 12, the conduit 22 is provided with a section 30 which is movable with respect to the inner end 28 as a result of breakage of a frangible section 31. In the present instance, the frangible section 31 is provided by milling away the outer periphery of the conduit 22 and thereby reducing its wall thickness circumferentially to leave a residual relatively small thickness of material in the wall. The relatively small thickness is capable of withstanding the pressure of the fuel supplied by the pump and normal operational forces on the hose 15 but breaks, or ruptures, readily when substantial axial and/or bending stresses are imposed on the outer end 27 of the conduit 22, such as if the hose 15 were displaced either axially or laterally with respect to the dispenser stanchion 12. In the illustrated embodiment, the weakened wall section 31 is provided by a substantially V-shaped groove in the periphery of the conduit 22. Preferably, the cut-off apparatus 11 is mounted in the dispenser stanchion 12 with the free end 27 of the conduit 22 disposed perpendicular to the path of movement of vehicles with respect to the dispenser 10. Thus, should the nozzle 16 be left in the tank of a vehicle, and the vehicle driven away from the dispenser 10, it would travel in a direction perpendicular to the plane of the sheet, and this would cause bending stresses to be created in the conduit 22 which would result in the rupture of its breakaway zone 31.

The servo control valve 19 is electrically actuated. For this purpose, it has a built-in solenoid 35 which, when supplied with electrical power, opens the valve 19 and affords fuel flow therethrough. The valve 19, however, is spring biased into a closed condition so that interruption of power to the solenoid 35 causes the valve 19 automatically to close and thereby to block the flow of fuel into the hose 15.

Figure 3:
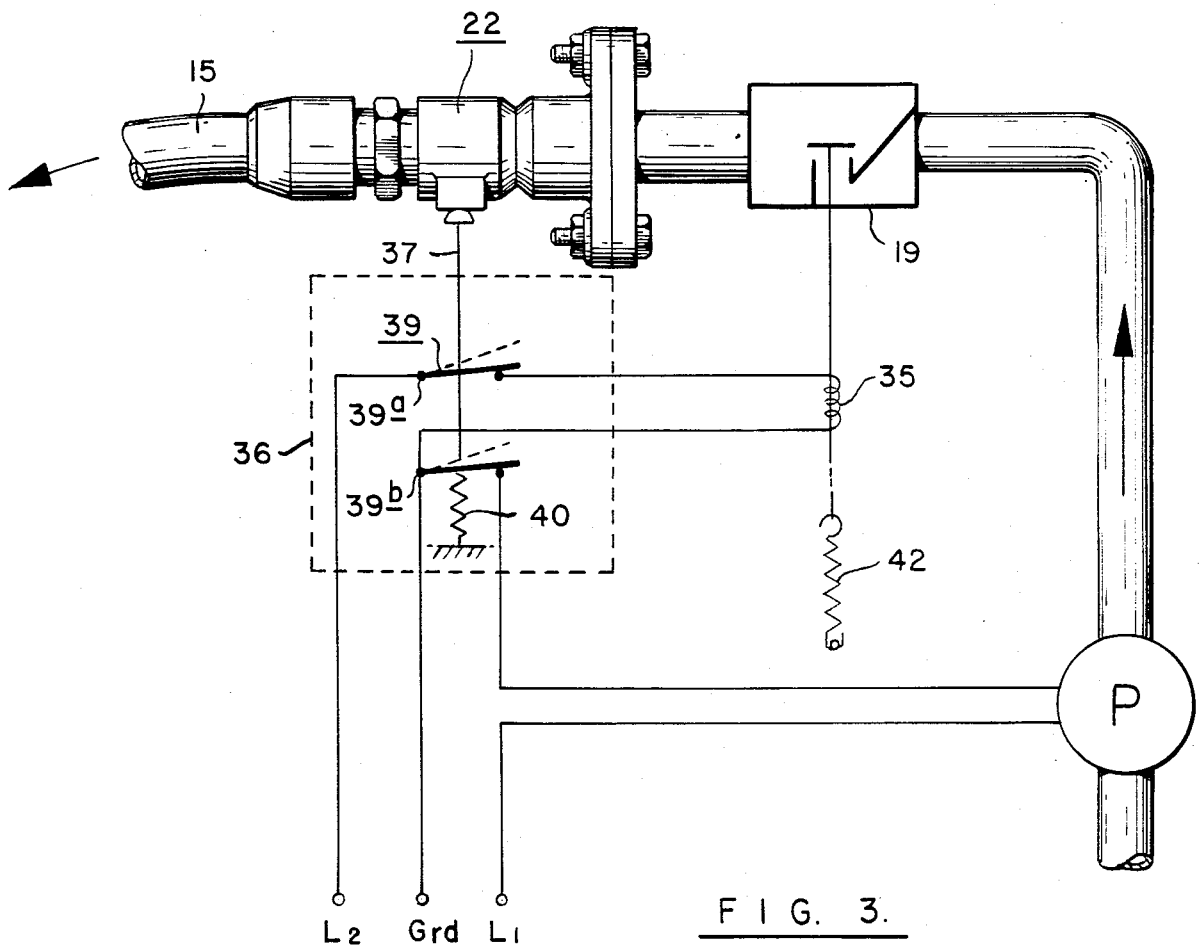
FIG. 3 is a schematic diagram of the emergency fuel flow cut-off apparatus of the present invention.

In order to detect breakage of the conduit 30 and to supply a signal for deenergizing the solenoid 35, a switch is contained in a housing 36 mounted to the base 18 adjacent the conduit 22. The switch has an actuator 37 which protrudes upwardly from the housing 36 and engages a boss 38 on the underside of the movable portion 30 of the conduit 22. As best seen in FIG. 3, the actuator 37 is connected directly to a double pole single throw switch 39 which is biased into a normally open position by a compression spring 40. The coil of the solenoid 35 is connected by means of wires to the upper pole blade **39*a* and a 120 volt AC power supply $L_2$, and to ground. The pump P is connected by means of wires to the lower pole blade 39*b* and ground, an to a 240 volt AC power supply. Thus, when the switch 39 is in the full line position illustrated in FIG. 3, power is supplied simultaneously to the coil of the solenoid 35 and to the pump P. As a result, the valve 19 is opened against the bias of its closing spring 42 and the pump P is driven to supply fuel in the direction indicated by the arrow through the valve 19 and out the hose 15. Of course, when the switch 39 is in the broken line position illustrated in FIG. 3, power to the coil of the solenoid 35** and to the pump P is simultaneously interrupted.

In operation, a patron of a self-service gas station drives his automobile adjacent to the dispenser 10 for refueling. Customarily, he will remove the nozzle 16 from its retainer 14 on the dispenser stanchion 12 and will turn on the switch 13 for energizing the pump P. The nozzle 16 is placed in the inlet of the fuel tank and operated in the customary manner to fill the tank.

Figure 4:
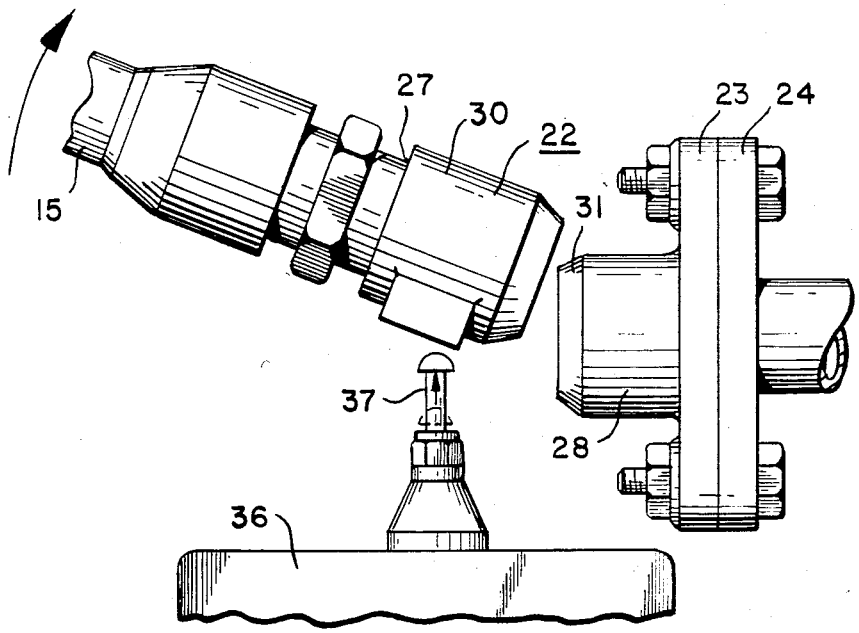
FIG. 4 is an enlarged fragmentary view of portions of the emergency fuel flow cut-off apparatus in the course of its operation.

In the event, however, that the patron should forget to the remove the nozzle 16 from the tank and to shut off the switch 13 before driving his automobile away from the service station, the hose 15 will be pulled laterally with respect to the dispenser stanchion 12. This will cause the conduit 22 to rupture at its breakaway zone 31 such as illustrated in FIG. 4. When this occurs, the movable portion 30 of the conduit 22 moves away from the fixed end 28 thereof, thereby enabling the switch actuator 37 to move upwardly from the broken line position into the full line position. This causes the switch 39 to open, thereby automatically deenergizing the solenoid 35 and enabling the spring 42 to close the valve 19 for preventing fuel from flowing through the valve 19. Simultaneously, the switch 39 also deenergizes the pump P to reduce pressure in the line to the valve 19.

Thus, it should be apparent that the apparatus 11 of the present invention functions quickly to prevent significant amounts of fuel from being discharged onto the ground around the dispenser 10 under the emergency conditions just described. As a result, the fire hazard associated with this type of accident is greatly reduced.

The construction of the emergency fuel flow shut-off device 11 is such that it can be repaired readily. Repair is made simply by unbolting the flanges 23 and 24 and removing the fixed end 28 of the broken conduit 22 and unscrewing the movable end 27 of the conduit 22 from the hose 15. Thereafter, a new conduit 22 can be mounted between the flange 24 and the hose 15 and engaged with the switch actuator 37 which is pressed downwardly into the broken line position illustrated in FIG. 4. Tightening of the bolts connecting the flanges 23 and 24 completes the repair process.

In view of the foregoing, it should be apparent that the present invention now provides an improved emergency fuel flow cut-off device which operates quickly and automatically to arrest the discharge of fuel from a fuel dispenser in the event that the hose of the dispenser should be subjected to excessive force causing it to separate from the dispenser. The apparatus of the present invention is relatively simple in construction and, therefore, economical to manufacture on a mass production basis. The apparatus can be repaired quickly by a serviceman in the event that it should be called upon to perform its emergency function as described above.

While a preferred embodiment of the present invention has been described in detail, various modifications, alterations and changes may be made without departing from the spirit and scope of the present invention as defined in the appended claims.

What is claimed is:

1. For use in combination with a fuel dispenser having a delivery hose and a pipe for supplying fuel under pressure to said hose, emergency fuel flow cut-off apparatus comprising:

an electrically actuated servo control valve adapted to be connected to said pipe, a short length of conduit having a zone of reduced wall thickness providing a frangible section located between opposite ends thereof, means connecting one upstream end of said conduit to said control valve, means adapted to connect the other downstream end of said conduit to said delivery hose, means mounted closely adjacent to said upstream end of said conduit to detect breakage of said frangible section and to produce an electrical signal, said breakage detecting means including an actuator disposed adjacent to the outside of said conduit only between said zone of reduced wall thickness and said hose connected other end, and operable in response to breakage of said reduced wall thickness zone to produce said electrical signal, and means for transmitting said signal to said control valve for causing the same to halt the flow of fuel from said delivery pipe.

2. The emergency cut-off apparatus according to claim 1 wherein said breakage detecting means includes means biasing said actuator into lateral engagement with said conduit at said only location, and including means responsive to movement of said actuator to produce said electrical signal.

3. The emergency cut-off apparatus accordng to claim 2 wherein said signal producing means includes a switch connected to said actuator and means electrically connecting said switch and said servo control valve, said servo control valve being normally closed in the absence of electrical power and said switch being normally open but being held closed by said actuator while engaged with said frangible conduit section.

4. In combination with a fuel dispenser having a flexible delivery hose for fueling a vehicle and means for supplying fuel under pressure to said hose, the improvement comprising:

a short conduit haing one end mounted stationary with respect to said dispenser, another end movable with respect to said dispenser, and a frangible section intermediate said ends, means providing fluid communication between said one end of said conduit and said fuel supply means, means coupling said delivery hose to said movable end of said conduit, a switch, means electrically connecting said switch and said fuel supply means to a power source, and a switch actuator laterally engaging the outside of said hose connected movable section of said conduit closely adjacent to said stationary section thereof and operable to actuate the switch upon a predetermined amount of movement of said hose connected movable section relative to said switch caused by rupture of said frangible section, whereby the switch operates to interrupt the flow of fuel from the fuel supply means in response to movement of the movable conduit section caused by said movement of the hose away from the dispenser and breakage of the frangible section.

5. The apparatus according to claim 4 wherein said conduit has a weakened wall section located between its ends and said movable section is located between said weakened wall and said movable end of said conduit.

6. The apparatus according to claim 5 wherein said weakened wall section is provided by a reduced wall thickness extending circumferentially in said conduit.

7. The apparatus according to claim 6 wherein said switch actuator laterally engages said movable section for sensing movement thereof.

8. The apparatus according to claim 4 wherein said fuel supply means includes a normally closed servo valve connected to said stationary section of said conduit, and means electrically connecting said valve to said switch for normally supplying power to said valve to afford fuel flow through the hose until said hose movement is detected.

9. The apparatus according to claim 4 wherein said fuel supply means includes a pump, and including means electrically connecting said switch to said pump for disabling said pump in response to said hose movement.

10. In a fuel dispenser having a stationary housing and a flexible fuel delivery hose, an emergency fuel flow cut-off device, comprising: a base adapted to mount to said housing, a normally closed solenoid valve mounted to said base, a conduit having one end connected to said valve and having an other end adapted to be connected to said flexible delivery hose, means providing a a frangible reduced thickness wall section in said conduit between its ends, a normally open switch carried on said base and having an actuator biased into lateral engagement with said conduit between its breakable wall section and said hose connectable other end, and means for supplying power to said solenoid valve through said switch, whereby rupture of the breakable wall section causes the actuator to move and open the switch for deenergizing the valve and blocking fuel flow therefrom.

* * * * *